United States Patent [19]

Johnson

[11] Patent Number: 4,458,181

[45] Date of Patent: Jul. 3, 1984

[54] LEAD-TYPE BALLAST APPARATUS WITH IMPROVED POWER FACTOR FOR OPERATING A HIGH-INTENSITY-DISCHARGE SODIUM LAMP

[75] Inventor: James C. Johnson, Vicksburg, Miss.

[73] Assignee: Cooper Industries, Inc., Houston, Tex.

[21] Appl. No.: 290,549

[22] Filed: Aug. 6, 1981

[51] Int. Cl.[3] ..... H05B 41/16

[52] U.S. Cl. ..... 315/247; 315/239; 315/276

[58] Field of Search ..... 315/247, 239, 276

[56] References Cited

U.S. PATENT DOCUMENTS

| | | | |
|---|---|---|---|
| 2,470,460 | 5/1949 | Bird | 315/247 |
| 2,502,084 | 3/1950 | Foerste | 315/247 |
| 2,565,234 | 8/1951 | Ilker | 315/247 |
| 3,029,363 | 4/1962 | Mauerer | 315/254 |
| 3,780,347 | 12/1973 | Riesland | 315/247 |

*Primary Examiner*—Harold Dixon

*Attorney, Agent, or Firm*—Spensley, Horn, Jubas & Lubitz

[57] ABSTRACT

A lead-type ballast apparatus for operating a HID high-pressure sodium lamp. The ballast apparatus includes an additional capacitor associated with the input portion thereof which provides a desirable power factor for the life of the lamp. Also disclosed is the addition of a supplemental winding to which the additional capacitor is connected that results in diminished operating losses for the ballast apparatus as the lamp ages.

2 Claims, 8 Drawing Figures

LEAD-TYPE BALLAST APPARATUS WITH IMPROVED POWER FACTOR FOR OPERATING A HIGH-INTENSITY-DISCHARGE SODIUM LAMP

BACKGROUND OF THE INVENTION

This invention relates to ballast apparatus for operating high-intensity-discharge (HID) high-pressure sodium vapor lamps and, more particularly, to a lead-type ballast having an improved power factor over the life of the lamp.

The conventional lead-type ballast has been utilized to successfully operate high-intensity-discharge lamps for many years. The circuit is characterized by a capacitor connected in series with the lamp. The capacitor functions to control lamp operation to provide inherent power factor correction. The lead-type ballast has been used, in recent years, to ballast HID sodium lamps. The HID sodium lamp is characterized by having a voltage that increases with age. As a result, limits in the maximum and minimum permissible lamp wattage and lamp voltage have been defined in the lamp industry as established by the American National Standards Institute (ANSI). These limits take the form of a trapezoid and HID sodium ballasts used today are designed to have the lamp operate within its boundaries over the life of the lamp.

To start the lamp, an electronic starting circuit is typically included as part of the ballast apparatus which provides pulses of sufficient voltage and duration until the lamp starts. The lead-type ballast is popular for use with the HID sodium lamp because it is intermediate in terms of cost and power losses while providing good wattage regulation. However, as the voltage of an HID sodium lamp increases with age the effect of the serially connected capacitor in maintaining power factor for the ballast apparatus is decreased.

Other ballasts have been utilized to operate HID sodium lamps, such as the magnetic regulated or constant wattage ballast which includes a voltage regulating section which feeds a current limiting reactor which maintains the desired power factor through the majority of lamp life. The drawback of this ballast though is its relatively high cost and comparatively much higher power loss level than the loss level that can be attained using the lead-type ballast.

One such lead-type ballast is disclosed in German Pat. No. 1,802,011, dated Oct. 11, 1967, issued to Nuckolls. In the Nuckolls patent a high reactance transformer with a condenser is included in the secondary circuit, by which an adjustable degree of concentration is achieved in the secondary magnetic circuit that provides control of the lamp current to compensate for any changes in the supply voltage, as shown in FIG. 3 of the Nuckolls patent. A bypass condenser for high frequencies is also included across the primary of the higher reactance transformer.

SUMMARY OF THE INVENTION

There is provided a lead-type ballast apparatus for operating a high-intensity-discharge high-pressure sodium vapor lamp, the lamp being characterized as having an increased voltage as the lamp ages. The lamp has a nominal rated operating wattage and a nominal rated operating voltage. The lamp characteristically displays an increasing operating voltage throughout its life resulting in established operating standards which specify that the permissible relative wattage and voltage operating characteristics which are experienced throughout lamp operating life fall within the confines of an established trapezoidal figure on a graph wherein increasing lamp wattage is linearly plotted on the graph right ordinate and increasing lamp voltage is linearly plotted on the graph abscissa. The horizontal parallel sides of the trapezoidal figure are being defined by minimum permissible and maximum permissible operating lamp wattages, and the remaining sides of the trapezoidal figure are defined by two lines of sharply rising slope wherein small increases in lamp operating voltage are reflected as relatively large increases in operating lamp wattage and which represent minimum permissible lamp voltages and maximum permissible lamp voltages at operating lamp wattages which vary from the minimum permissible to the maximum permissible operating lamp wattages. The operating characteristics of the lamp throughout its normally anticipated life are describable by a first curve of lamp wattage vs. lamp voltage. A second curve can be plotted on the graph to represent power factor of the ballast apparatus, linearly plotted on the left ordinate, as a function of lamp voltage. The first lamp operating curve enters into the trapezoidal figure through the line representing minimum permissible lamp voltages and exit from the trapezoidal figure through the line representing maximum permissible lamp voltages.

The lead-type ballast apparatus comprises an inductive reactance portion and a capacitive reactance portion. The inductive reactance portion comprises a current limiting high-reactance transformer means constructed either as an autotransformer or an isolated transformer. In the case of an autotransformer construction, the transformer means comprises a common winding means including an input section having input terminals connected thereto. The transformer means further comprises supplemental winding means connecting in circuit with one end portion of the common winding means and terminating in a floating free end winding portion, and secondary winding means having one end thereof connecting to the one end portion of the common winding means, the other end of the secondary winding means and the other end portion of the common winding means having output terminals connected thereto. The output terminals are connected in circuit with the lamp. In the case of an isolated transformer construction, the transformer means comprises a primary winding means having input terminals connected thereto. The transformer means further comprises a supplemental winding means connecting in circuit with one end portion of the primary winding means and terminating in a floating free end winding portion, and secondary winding means having output terminals connected thereto, with the output terminals in circuit with the lamp. The supplemental winding means between the free end winding portion and one of the input terminals, during operation of the ballast apparatus, has developed between the free end winding portion and the one input terminal a potential which is substantially greater than the input potential applied across the input terminals.

The capacitive reactance portion comprises a first capacitor means of predetermined capacitance in series circuit with the lamp. The capacitive reactance portion further comprises a second capacitor means of predetermined capacitance connected across the floating free end winding portion of the supplemental winding means and the one input terminal. The second capacitor means has a predetermined capacitance such that the ballast apparatus maintains at least a 0.9 power factor from the point at which the lamp operating curve enters the trapezoidal figure through the line representing minimum permissible lamp voltages until the lamp operating curve exits from the trapezoidal figure through the line representing maximum permissible lamp voltage, whereby as the lamp ages and the operating voltage rises, the second capacitor maintains a relatively high power factor for the ballast apparatus thereby limiting the rise in line current throughout the life of the lamp and reducing ballast operating losses.

A lead-type ballast apparatus similar to the apparatus described but without the supplemental winding means is also disclosed.

BRIEF DESCRIPTION OF THE DRAWINGS

For a better understanding of the invention, reference may be had to the preferred embodiments exemplary of the invention, shown in the accompanying drawings, in which.

BRIEF DESCRIPTION OF THE PREFERRED EMBODIMENTS

Figure 1:
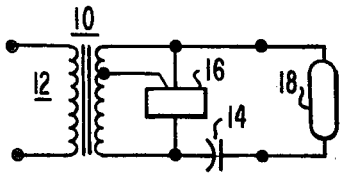
PRIOR ART FIG. 1
FIG. 1 is a schematic diagram of a lead-type ballast apparatus of the prior art.
Figure 2:
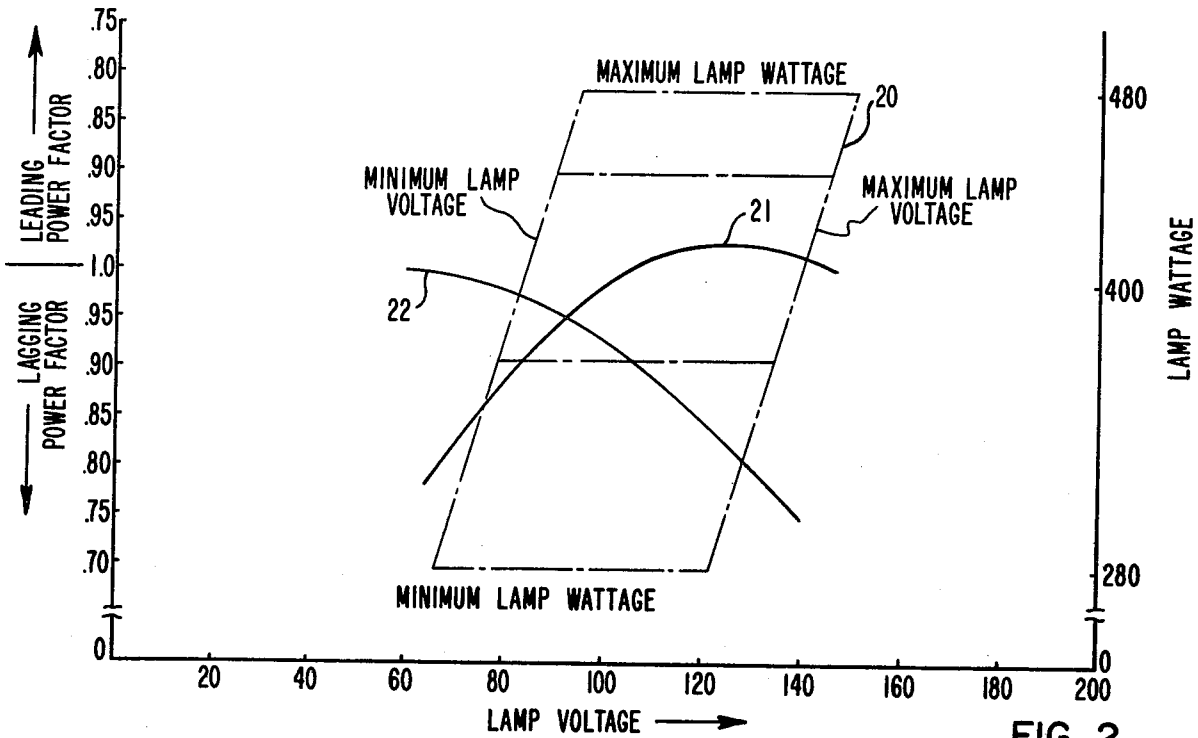
FIG. 2 PRIOR ART
FIG. 2 is a graph showing the established trapezoidal figure with a first curve of the operating characteristics of a typical 400 watt high pressure sodium lead-type ballast apparatus of the prior art and a second curve of the power factor of the ballast apparatus as a function of lamp voltage, wherein power factor is linearly plotted on the left ordinate of the graph and the lamp wattage is linearly plotted on the right ordinate of the graph and the lamp voltage on the abscissa; and, FIG. 3 is a schematic diagram of a lead-type ballast apparatus of the present invention with an autotransformer construction utilizing a supplemental winding means to develop potential substantially greater than the input potential across the input terminals.

With reference to FIG. 1 there is shown a lead-type ballast apparatus 10 of the prior art utilizing a current-limiting high-reactance transformer means 12 which as shown in FIG. 1 is an isolation transformer construction. An autotransformer construction is an alternative construction known in the art. The lead-type ballast causes the current through the lamp to decrease with increasing lamp voltage to keep the lamp operating wattage within the trapezoid shown in FIG. 2. It provides wattage regulation for changes both in line voltage and lamp wattage and is less costly and has lower wattage losses than a magnetic regulated ballast. The capacitor 14 shown in the prior art circuit in FIG. 1 functions both to control lamp operation and to provide inherent power factor correction. As already stated the problem with the prior art circuit is that as the voltage of the high pressure sodium lamp increases with age, the effect of the series capacitor 14 in maintaining power factor is diminished because the current through capacitor 14 decreases as lamp voltage rises. The curve 21 sets forth a typical operating curve of lamp wattage vs. voltage and curve 22 in FIG. 2 plots power factor vs. lamp voltage and is typical for a 400 watt lead-type ballast apparatus of the prior art and shows how the power factor decreases as the lamp voltage increases. In present day usage the resultant input circuit volt amps may increase 20 to 25% above the rated value as the lamp ages. Other ballasts utilized in the lamp industry, particularly, the magnetically regulated or constant voltage type, have maintained power factor through the majority of lamp life; however, the loss level associated with the magnetically regulated type of ballast is much higher than the loss level which can be achieved using the lead-circuit ballast. Typically for a 400 watt ballast a magnetically regulated type has a loss level on the order of 82 watts compared to a lead-type ballast apparatus with a loss level of about 58 watts. Also shown in FIG. 1 is a starter 16 which is typically an electronic starting circuit such as disclosed in U.S. Pat. No. 4,143,304 issued to Hitchcock et al. which provides a pulse of sufficient voltage and duration, at least once per cycle, until the lamp is started. Because of the reduced effect of the capacitor 14 in the prior art lead-type ballast apparatus to control power factor as the lamp ages, the lighting system must be designed for increased line current as the power factor decreases. For example, for a 400 watt ballast apparatus of the prior art the line current will approach about 5.2 amps approaching end of life of the lamp with 120 volt input.

Figure 3:
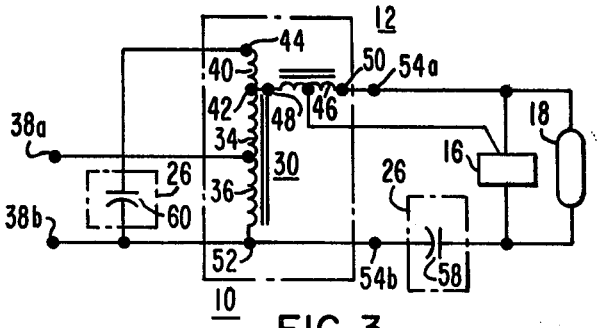
Figure 4:
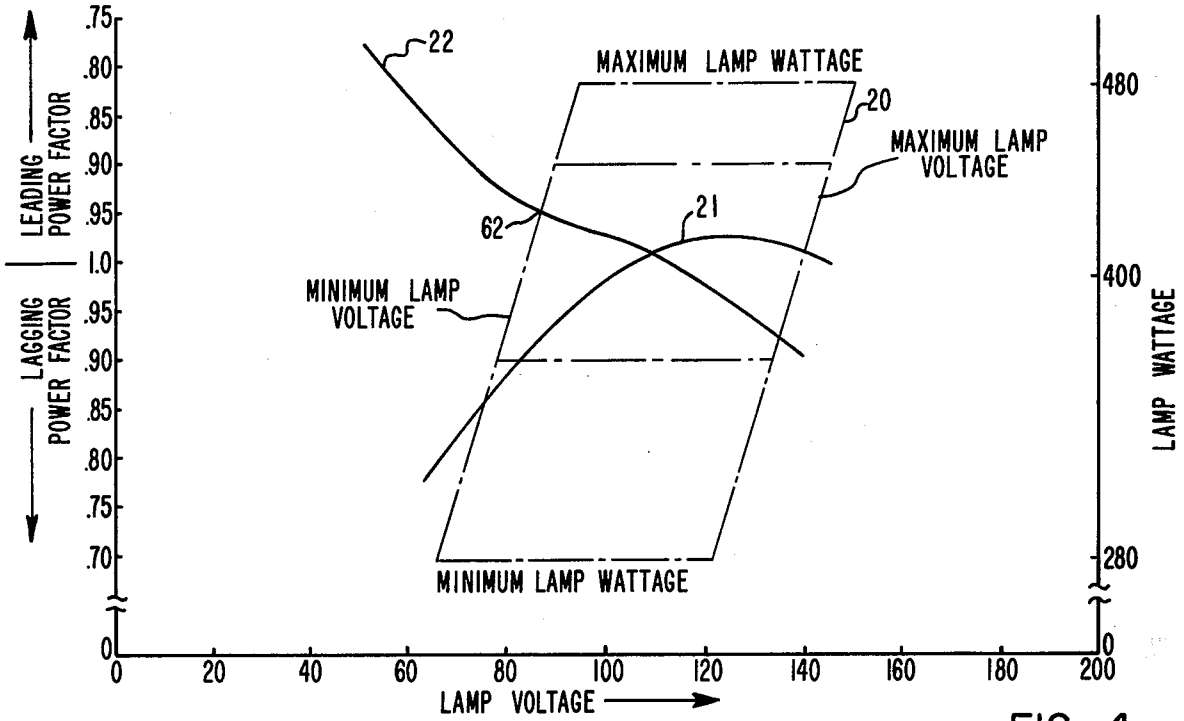
FIG. 4 is a graph showing the established trapezoidal figure with a first curve of the operating characteristics of a 400 watt high pressure sodium lead-type ballast apparatus of the present invention and a second curve of the power factor of the ballast apparatus as a function of lamp voltage with the graph having the same axes as shown in FIG. 2.

Referring to FIGS. 3 and 4 there is shown a lead-type ballast apparatus 10 for operating a high-intensity-discharge (HID) high-pressure sodium lamp 18. The lamp 18 has a nominal rated operating wattage such as 400 watts and a nominal rated operating voltage such as 100 volts. The lamp 18 characteristically displays an increasing operating voltage throughout its life resulting in established operating standards by the American National Standard Institute which are well known in the art. The standards specify that the permissible relative wattage and voltage operating characteristics which are experienced throughout the operating life of a high-pressure sodium lamp fall within the confines of an established trapezoidal figure on a graph, such as shown in FIGS. 2 and 4, wherein increasing lamp wattage is linearly plotted on the graph right ordinate and increasing lamp voltage is linearly plotted on the graph abscissa, see FIGS. 2 and 4. The horizontal parallel sides of the trapezoidal figure 20 being defined by minimum permissible and maximum permissible operating lamp wattages such as 280 watts and 480 watts, respectively, for a 400 watt lamp. The remaining sides of the trapezoidal figure 20 defined by two lines of sharply rising slope wherein small increases in lamp operating voltage are reflected as relatively large increases in operating lamp wattage and which represent minimum permissible lamp voltages and maximum permissible lamp voltages at operating lamp wattages which vary from the minimum permissible to the maximum permissible operating lamp wattages. The operating characteristics of the lamp 18 throughout its normally anticipated life are describable by a first curve 21. A second curve 22 on the graph represents the power factor of the ballast apparatus as a function of lamp voltage. The first curve 21 enters into the trapezoidal figure 20 through the line representing minimum permissible lamp voltages and exits from the trapezoidal figure 20 through the line representing maximum permissible lamp voltages, see FIGS. 2 and 4.

Figure 5:
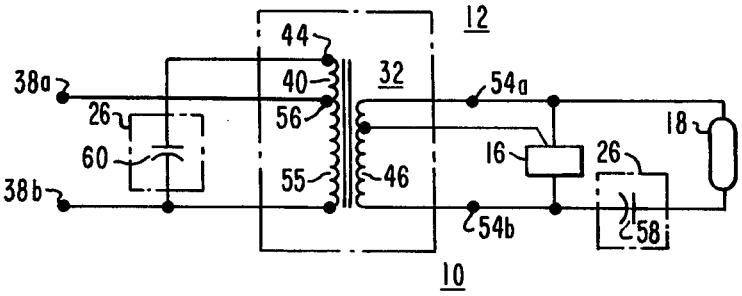
FIG. 5 is a schematic diagram of the present invention with an isolation transformer construction including the supplemental winding connected in circuit with one end portion of the primary winding.

The lead-type ballast apparatus 10 comprises an inductive reactance portion 24 and a capacitive reactance portion 26. The inductive reactance portion comprises a current limiting high-reactance transformer means 12 constructed either as an autotransformer 30 as shown in FIG. 3 or an isolated transformer 32 as shown in FIG. 5 where like numerals indicate like parts. In the case of an autotransformer construction, the transformer means 12 comprises a common winding means 34 including an inut section 36 having input terminals 38*a*, 38*b* connected thereto. A supplemental winding means 40 is included and connected in circuit with one end portion 42 of the common winding means 34 and terminates in a floating free end winding portion 44. A secondary winding means 46 has one end 48 thereof connecting to the one end porton 42 of the common winding means 34. The other end 50 of the secondary winding means 46 and the other end portion 52 of the common winding means having output terminals 54*a*, 54*b* connected in circuit with the lamp 18.

Referring to FIG. 5, in the case of an isolated transformer construction, the transformer means 12 comprises a primary winding means 55 having input terminals 38*a*, 38*b* connected thereto. A supplemental winding means 40 is connected in circuit with one end portion 56 of the primary winding means 55 and terminates in a floating free end winding portion 44. The secondary winding means 46 has output terminals 54*a*, 54*b* connected thereto. The output terminals 54*a*, 54*b* are in circuit with the lamp 18.

Supplemental winding means 40 in both the autotransformer construction and isolation transformer construction, between the free end winding portion 44 and one of the input terminals 38*b*, during operation of the ballast apparatus 10, has developed between the free end winding portion 44 and the one input terminal 38*b* a potential which is substantially greater than the input potential applied across the input terminals 38*a*, 38*b*. For example, for a 400 watt lamp with 120 volts across the input terminals 38*a*, 38*b* there is developed 277 volts between the floating free end portion 44 of the supplemental winding 40 and the one input terminal 38*b*.

The capacitive reactance portion 26 comprises a first capacitor means 58 of predetermined capacitance in series circuit with the lamp 18. The capacitive reactance portion 26 further comprises second capacitor means 60 of predetermined capacitance connected across the floating free end winding portion 44 of the supplemental winding means 40 and the one input terminal 38*b*. The second capacitor means 60 has a predetermined capacitance such that the ballast apparatus 10 maintains at least a 0.9 power factor, with reference to FIG. 4, from the point 62 at which the first curve 21 enters the trapezoidal figure 20 through the line representing minimal permissible lamp voltages until the first curve 21 exits from the trapezoidal figure 20 through the line representing maximum permissible lamp voltage.

As can be seen after comparing the second curve 22 of the prior art circuit in FIG. 2 to the second curve 22 of the present invention in FIG. 4, the second curve 22 of the prior art circuit enters the left side of the trapezoid with a lagging power factor which steadily becomes more lagging, whereas, with the use of the second capacitor 60 in the present invention the curve 22 does not go from lead to lag until it reaches approximately the nominal operation voltage of the lamp, which is 100 volts in the case of a 400 watt lamp. Preferably the ratio of the capacitance of the first capacitor means 58 as measured in microfarads to the capacitance of the second capacitor means 60 as measured in microfarads is from 2.5:1 to 11:1, with an operating voltage of the second capacitor 60, the capacitance of the second capacitor at the other operating voltage is first modified, before the ratio is applicable, by the formula:

$$C_2 = \frac{C_2^1 V_{c2}^2}{(277)^2}$$

where $V_{c2}$ is the actual operating voltage of the second capacitor 60, $C_2^1$ is the capacitance of the second capacitor at any other operating voltage and $C_2$ is the capacitance of the second capacitor 60 at 277 volts RMS.

Utilizing this invention as the lamp ages and the operating voltage rises the second capacitor means 60 maintains a relatively high power factor for the ballast apparatus 10 thereby limiting the rise in line current throughout the life of the lamp and reducing ballast operating losses. The prior art 400 watt ballast had about a 58 watt power loss near end of lamp life. It has been found with the ballast apparatus of our present inventory the power loss of the ballast apparatus is 48 to 50 watts near end of lamp life for a 400 watt ballast due to the improved power factor.

By way of example for this embodiment, the high reactance transformer means 12 for a 400 watt lamp, in the case of the autotransformer 30 shown in FIG. 3, may be a transformer manufactured by Advance Transformer Company, Catalogue No. 71A8472 or in the case of the isolated transformer shown in FIG. 5 may be a transformer manufactured by Westinghouse Electric Corporation, Model No. 8437078G06. Utilizing the 277 volt tap on both the autotransformer and isolated transformer as the voltage applied across the capacitor 60 as shown in FIGS. 3 and 5 and a 120 volt input across input terminals 38*a*, 38*b*, the first capacitor 58 is 48 μF. and the second capacitor 60 is 12 μF. The ratio of the capacitance of the first capacitor 58 to the second capacitor 60 is 4:1. This arrangement produces a curve 22 such as shown in FIG. 4 with the power factor for the ballast apparatus 10 maintained at least 0.9 or above through the trapezoidal figure 20. Maintaining at least a 0.9 power factor for the ballast apparatus 10 results in a reduced line current of 4.2 amps for this embodiment compared to the prior art line current of 5.2 amps approaching end of life of the lamp.

Figure 6:
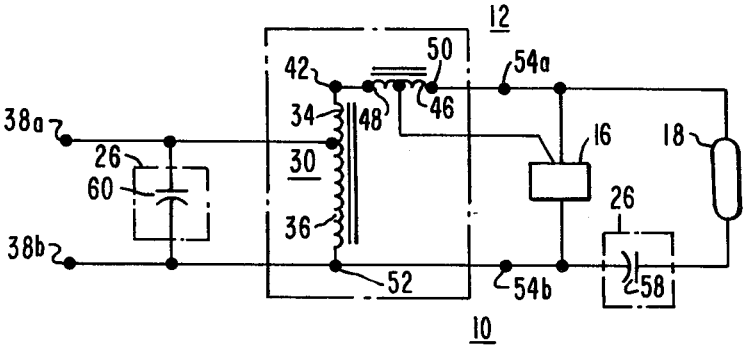
FIG. 6 is a schematic diagram of the present invention of an autotransformer construction without the supplemental winding.
Figure 7:
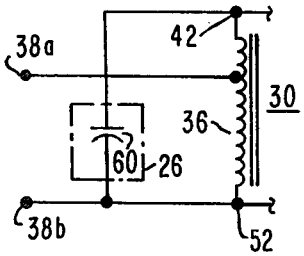
FIG. 7 is a schematic diagram of the present invention showing capacitor 60 connected to another portion of the common winding 30 than that shown in FIG. 6, the remainder of the circuit not shown being identical to the circuit of FIG. 6.
Figure 8:
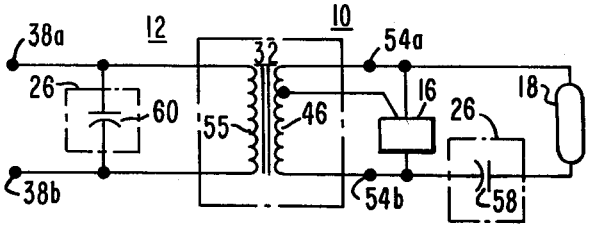
FIG. 8 is a schematic diagram of the present invention with an isolation transformer construction without the supplemental winding.

Another embodiment of the invention without the use of the supplemental winding 40 is shown in FIGS. 6, 7 and 8. As was the case with the previous embodiment the current-limiting high-reactance transformer means 12 may be constructed either as an autotransformer 30 shown in FIGS. 6 and 7 or an isolated transformer 32 shown in FIG. 8. In the case of the autotransformer construction, the transformer means 12 comprises common winding means 34 including an input section 36 having input terminals 38*a*, 38*b* connected thereto and secondary winding means 46 having one end 48 thereof connecting to one end portion 42 of the common winding means 34. The other end 50 of the secondary winding means 46 and the other end portion 52 of the common winding means 34 have output terminals 54*a*, 54*b* connected thereto. In the case of an isolated transformer construction shown in FIG. 8, the transformer means 12 comprises a primary winding means 55 having input terminals 38*a*, 38*b* connected thereto and secondary winding means 46 having output terminals connected thereto. The output terminals 54*a*, 54*b* are in circuit with the lamp 18. In this embodiment the improvement comprises the capacitive reactance portion 26 of both the autotransformer construction and the isolated transformer construction, comprises a first capacitor means 58 of predetermined capacitance in series circuit with the lamp 18. The capacitive reactance portion 26 further comprises a second capacitor means 60 of predetermined capacitance. In the case of an autotransformer construction, the second capacitor means 60 is connected across the input terminals 38*a*, 38*b*, as shown in FIG. 6, or a predetermined other portion of the common winding as shown in FIG. 7. In the case of an isolated transformer construction shown in FIG. 8, the second capacitor means 60 is connected across the input terminals 38*a*, 38*b*. The second capacitor means has a predetermined capacitance such that the ballast apparatus maintains at least a 0.9 power factor as described for the previous embodiment, see FIG. 4. Also the ratio of the capacitance of the first capacitor means 58 to the capacitance the second capacitor means 60 as described in the previous embodiment is preferably from about 2.5:1 to 11.0:1. In this embodiment utilizing either an autotransformer or isolated transformer, which may be the same transformers used in the example of the previous embodiment without using the 277 volt tap on the supplemental winding, 120 volts is applied across the second capacitor 60. the second capacitor 60 is 64 microfarads and the first capacitor 58 is 48 microfarads. Applying the previously described formula, where in this case, $V_{C2}=120$, $C_2^1=64$ it is found that $C_2=12$ microfarads, so that the ratio of the first capacitor 58 to the second capacitor 60 is 4:1.

I claim:

1. A lead-type ballast apparatus for operating an HID high-pressure sodium lamp, said lamp having a nominal rated operating wattage and a nominal rated operating voltage, said lamp characteristically displaying an increasing operating voltage throughout its life resulting in established operating standards which specify that the permissible relative wattage and voltage operating characteristics which are experienced throughout lamp operating life fall within the confines an established trapezoidal figure on a graph wherein increasing lamp wattage is linearly plotted on the graph right ordinate and increasing lamp voltage is linearly plotted the graph abscissa, the horizontal parallel sides of the trapezoidal figure being defined by minimum permissible and maximum permissible operating lamp wattages, and the remaining sides of the trapezoidal figure defined by two lines of sharply rising slope wherein small increases in lamp operating voltage are reflected as relatively large increases in operating lamp wattage and which represent minimum permissible lamp voltages and maximum permissible lamp voltages at operating lamp wattages which vary from said minimum permissible to said maximum permissible operating lamp wattages, and the wattage consumption said lamp as a function of the operating voltage of said lamp is describable by a curve on said graph which enters into the trapezoidal figure through said line representing minimum permissible lamp voltages and exits from the trapezoidal figure through said line representing maximum permissible lamp voltages, said lead-type ballast apparatus comprising an inductive reactance portion and a capacitive reactance portion, said inductive reactance portion comprising a current-limiting high-reactance transformer means constructed either as an autotransformer or an isolated transformer; in the case of an autotransformer construction, said transformer means comprising a common winding means including an input section having input terminals connected thereto, supplemental winding means connecting in circuit with one end portion of said common winding means and terminating in a floating free end winding portion, secondary winding means having one end thereof connecting to said one end portion of said common winding means, the other end of said secondary winding means and the other end portion of said common winding means having output terminals connected thereto, said output terminals connected in circuit with said lamp; in the case of an isolated transformer construction, said transformer means comprising a primary winding means having input terminals connected thereto, a supplemental winding means connecting in circuit with one end portion of said primary winding means and terminating in a floating free end winding portion, and secondary winding means having output terminals connected thereto, said output terminals being adapted to couple in circuit with said lamp, said supplemental winding means being adapted during operation of said ballast apparatus to develop between said free end winding portion and said one input terminal a potential which is substantially greater than the input potential applied across said input terminals, said capacitive reactance portion comprising a first capacitor means of predetermined capacitance in series circuit with said lamp, and second capacitor means of predetermined capacitance connected across said floating free end winding portion of said supplemental winding means and said one input terminal, said second capacitor means having a predetermined capacitance such that said ballast apparatus maintains at least a 0.9 power factor from the point at which said curve enters said trapezoidal figure through said line representing minimum permissible lamp voltages until said curve exits from said trapezoidal figure through said line representing maximum permissible lamp voltage, wherein the ratio of the capacitance of said first capacitor means as measured in microfarads to the capacitance of said second capacitor means as measured in microfarads is from 2.5:1 to 11:1, with an operating voltage of said second capacitor means of 277 volts RMS; with any other operating voltage of said second capacitor means, the capacitance of said second capacitor means at said other operating voltage is first modified, before said ratio is applicable, by the formula:

$$C_2 = \frac{C_2^1 V_{C2}^2}{(277)^2}$$

where $V_{c2}$ is the actual operating voltage of said second capacitor means, $C_2^1$ is the capacitance of said second capacitor at any other operating voltage and $C_2$ is the capacitance of said second capacitor means at 277 volts RMS; whereby as said lamp ages and the operating voltage rises, said second capacitor means maintains a relatively high power factor for said ballast apparatus thereby limiting the rise in line current throughout the life of the lamp and reducing low ballast operating losses.

2. In combination with a lead-type ballast apparatus for operating an HID high-pressure sodium lamp, said lamp having a nominal rated operating wattage and a nominal rated operating voltage, said lamp characteristically displaying an increasing operating voltage throughout its life resulting in established operating standards which specify that the permissible relative wattage and voltage operating characteristics which are experienced throughout lamp operating life fall within the confines of an established trapezoidal figure on a graph wherein increasing lamp wattage is linearly plotted on the graph ordinate and increasing lamp voltage is linearly plotted on the graph abscissa, the parallel sides of the trapezoidal figure being defined by minimum permissible and maximum permissible operating lamp wattages, and the remaining sides of the trapezoidal figure defined by two lines of sharply rising slope wherein small increases in lamp operating voltage are reflected as relatively large increases in operating lamp wattage and which represent minimum permissible lamp voltages and maximum permissible lamp voltages at operating lamp wattages which vary from said minimum permissible to said maximum permissible operating lamp wattages, and the wattage consumption of said lamp as a function of the operating voltage of said lamp is describable by a curve which enters into the trapezoidal figure through said line representing minimum permissible lamp voltages and which curve exits from the trapezoidal figure through said line representing maximum permissible lamp voltages, said lead-type ballast apparatus comprising an inductive reactance portion and a capacitive reactance portion, said inductive reactance portion comprising a current-limiting high-reactance transformer means constructed either as an autotransformer or an isolated transformer; in the case of an autotransformer construction, said transformer means comprising a common winding means including an input section having input terminals connected thereto and secondary winding means having one end thereof connecting to one end portion of said common winding means, the other end of said secondary winding means and the other end portion of said common winding means having output terminals connected thereto, said output terminals connected in circuit with said lamp; in the case of an isolated transformer construction, said transformer means comprising a primary winding means having input terminals connected thereto and secondary winding means having output terminals connected thereto, with said output terminals in circuit with said lamp, the improvement which comprises:

said capacitive reactance portion comprising a first capacitor means of predetermined capacitance in series circuit with said lamp and said output terminals, a second capacitor means of predetermined capacitance, in the case of an autotransformer construction, said second capacitor means connected across said input terminals or a predetermined other portion of said common winding; in the case of an isolated transformer construction, said second capacitor means connected across said input terminals, said second capacitor means having a predetermined capacitance such that said ballast apparatus maintains at least a 0.9 power factor from the point at which said curve enters said trapezoidal figure through said line representing minimum permissible lamp voltages until said curve exits from said trapezoidal figure through said line representing maximum permissible lamp voltage, wherein the ratio of the capacitance of said first capacitor means as measured in microfarads to the capacitance of said second capacitor means as measured in microfarads is from 2.5:1 to 11:1, with an operating voltage of said second capacitor means of 277 volts RMS; with any other operating voltage of said second capacitor means, the capacitance of said second capacitor means at said other operating voltage is first modified, before said ratio is applicable, by the formula:

$$C_2 = \frac{C_2^1 V_{c2}^2}{(277)^2}$$

where $V_{c2}$ is the actual operating voltage of said second capacitor means, $C_2^1$ is the capacitance of said second capacitor at any other operating voltage and $C_2$ is the capacitance of said second capacitor means at 277 volts RMS; whereby as said lamp ages and the lamp operating voltage rises, said second capacitor maintains a relatively high power factor for said ballast apparatus thereby limiting the rise in line current throughout the life of the lamp with low ballast operating losses.

* * * * *